US008113281B2

(12) United States Patent
Diehl et al.

(10) Patent No.: US 8,113,281 B2
(45) Date of Patent: Feb. 14, 2012

(54) METHOD AND APPARATUS FOR IN SITU EXTRACTION OF BITUMEN OR VERY HEAVY OIL

(75) Inventors: Dirk Diehl, Erlangen (DE); Norbert Huber, Erlangen (DE); Hans-Peter Krämer, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 62 days.

(21) Appl. No.: 12/674,763

(22) PCT Filed: Aug. 19, 2008

(86) PCT No.: PCT/EP2008/060817

§ 371 (c)(1),
(2), (4) Date: Feb. 23, 2010

(87) PCT Pub. No.: WO2009/027262

PCT Pub. Date: Mar. 5, 2009

(65) Prior Publication Data

US 2011/0042085 A1 Feb. 24, 2011

(51) Int. Cl.
*E21B 43/24* (2006.01)
*E21B 36/00* (2006.01)

(52) U.S. Cl. ..... 166/272.3; 166/65.1; 166/248; 166/272.1

(58) Field of Classification Search ..... None
See application file for complete search history.

(56) References Cited

U.S. PATENT DOCUMENTS

| | | | |
|---|---|---|---|
| 4,116,273 | A | 9/1978 | Fisher |
| 4,620,592 | A | 11/1986 | Perkins |
| 4,645,004 | A | 2/1987 | Bridges |
| 6,257,334 | B1 | 7/2001 | Coates |
| 7,011,154 | B2 | 3/2006 | Maher et al. |

FOREIGN PATENT DOCUMENTS

| | | | |
|---|---|---|---|
| RU | 2049914 | C1 | 10/1995 |
| RU | 9008 | U1 | 1/1999 |
| RU | 36857 | U1 | 3/2004 |
| WO | WO 03/054351 | A1 | 7/2003 |
| WO | WO 2006115943 | A1 | 11/2006 |

*Primary Examiner* — Zakiya W Bates

(57) ABSTRACT

A method to extract bitumen or very heavy oil in situ from oil sand seams close to the Earth's surface is provided. Energy is introduced via at least two pipes at a given, repeatable distance from the seam, a predefined geometry is maintained in relation to the well pair. The associated apparatus includes at least one additional pipe which is alternatively designed as an electrode or also for feeding vapor and is placed above the injection pipe.

17 Claims, 3 Drawing Sheets

METHOD AND APPARATUS FOR IN SITU EXTRACTION OF BITUMEN OR VERY HEAVY OIL

CROSS REFERENCE TO RELATED APPLICATIONS

This application is the US National Stage of International Application No. PCT/EP2008/060817, filed Aug. 19, 2008 and claims the benefit thereof. The International Application claims the benefits of German application No. 10 2007 040 606.3 DE filed Aug. 27, 2007. All of the applications are incorporated by reference herein in their entirety.

FIELD OF INVENTION

The invention relates to a method for the in situ extraction of bitumen or very heavy oil from reservoirs in the faun of oil sand deposits close to the surface, thermal energy being supplied to the reservoir to reduce the viscosity of the bitumen or very heavy oil, to which end elements are used to introduce energy into the reserve and extraction pipes are used to recover the liquefied bitumen or very heavy oil. The invention also relates to the associated apparatus, with at least one element for introducing energy and also an extraction pipe.

BACKGROUND OF INVENTION

During the in situ breaking down of bitumen from oil sand by means of steam and horizontal bore holes according to the SAGD (Steam Assisted Gravity Drainage) method the problem arises with thin bitumen strata in particular that only an economically limited quantity of bitumen can be tapped. In the most favorable instance this is around 40 to 60% of the bitumen present in the reservoir but much less in the case of thin strata. The reason for this is the limited width of the growing steam chamber, which is typically around twice as wide as it is high. For a high yield in flat reservoirs (20 to 30 m) this means that an injection pipe must be provided to introduce energy every 40 to 60 m above the extraction pipe. The two pipes, one on top of the other, are known in the pertinent prior art as so-called well pairs.

A specific SAGD method for extracting very heavy oil is known from U.S. Pat. No. 6,257,334 B1, in which, in addition to a so-called well pair consisting of pipes one on top of the other, further elements are also present, which are intended to improve the heating of the region. Also in WO 03/054351 A1 a facility for the electrical heating of certain regions is described, with which a field is generated between two electrodes, heating the region in between them.

In the prior art the well pairs are provided at small intervals, incurring high costs for horizontal boring and piping. Alternatively high yields would have to be sacrificed to save costs.

SUMMARY OF INVENTION

On this basis the object of the invention is to propose an improved method for extracting bitumen or very heavy oil and to create an associated apparatus.

According to the invention the object in respect of the method is achieved by the measures of the claims and in respect of the apparatus by the features of the claims. Developments of the method and the associated apparatus are set out in the subclaims.

With the invention the following method steps in particular are implemented: —the energy is introduced in each instance in a predeterminable section of the reservoir by way of at least two separate elements, a predetermined geometry of the elements being maintained in relation to the extraction pipe; —to introduce the energy by way of the separate elements, at least one further pipe is used to introduce steam and/or as an electrode for electrical energization; —the injection pipe and the energization pipe are connected in the manner of an electrical conductor loop; —outer regions of the reservoir are also supplied with thermal energy at least by way of the further pipe. The energy can be introduced in a repeatable manner at predeterminable points of the reservoir. To this end the associated apparatus has at least one extraction pipe per defined unit of the reservoir, the extraction pipe running in a horizontal direction on the bottom of the reservoir, with at least two further energy introduction elements running in a horizontal direction above it at a predetermined upward distance and lateral distance from the extraction pipe.

The object of the invention is therefore to introduce thermal energy at precisely defined points of the reservoir, with separate paths being used to introduce the energy. This can be achieved in particular by introducing additional horizontal pipes into the reservoir and further heating the bitumen which would otherwise remain cold. Since only individual pipes are to be used for this rather than pipe pairs, relatively low costs can be anticipated.

Based on experience with the inductive heating of oil sand reservoirs, it has shown that bitumen heats up extensively and not only in the discrete environment of the electrodes. It can be deduced from this that bitumen and/or very heavy oil can be extensively melted by means of individual additional electrodes and its viscosity reduced, so that it can then flow into an existing SAGD well pair system with a steam bubble and be extracted.

The inventive procedure allows a significantly higher bitumen yield to be achieved. Economic viability calculations promise success. Heating by means of this additional horizontal pipe can take place from the start, continuously at comparatively low power or with a time offset at appropriately higher power. It is important that the conventional SAGD process with the growing steam chamber is not disrupted by early flooding.

The later connection of an additional heating unit should in particular also be seen as advantageous as a retrofitting solution for existing SAGD reservoirs, which only promise a low yield.

The additional heating pipe does not necessarily have to be electrically operated but can optionally also be an injection pipe operated in steam cycling mode, in other words the hot steam is not released into the reservoir but conveyed back there. This produces a heating process which is propagated into the volume simply by thermal conduction.

BRIEF DESCRIPTION OF THE DRAWINGS

Further details and advantages of the invention will emerge from the description of figures of exemplary embodiments which follows based on the drawing in conjunction with the subclaims, in which drawing:

DETAILED DESCRIPTION OF INVENTION

Figure 1:
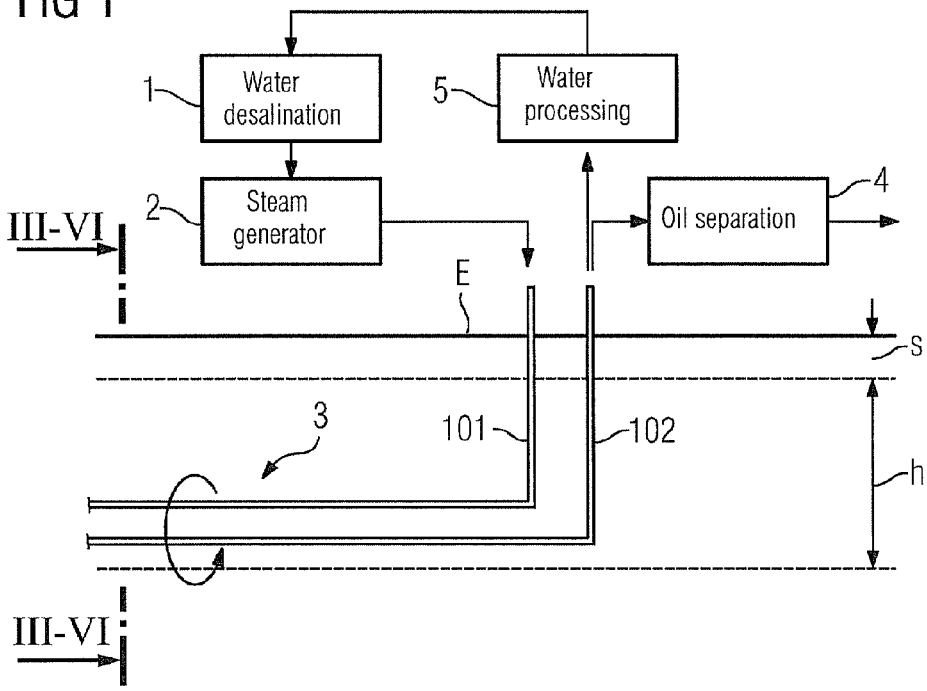
FIG. 1 shows a sectional diagram through a deposit according to the prior art.

In FIG. 1 a thick line E shows the ground surface, below which an oil sand deposit is located. Generally a superstructure of rock or other material is present below the ground surface, followed by a seam in the form of an oil sand reservoir at a predetermined depth. The seam has a height or thickness h, a length l and a width w. The seam therefore contains the bitumen or very heavy oil and is referred to below as the reservoir 100. With the known SAGD method an injection pipe 101 for steam and an extraction pipe 102, also referred to as a production pipe, are routed horizontally on the base of the reservoir 100.

FIG. 1 shows an outline of a method according to the prior art. Externally, i.e. above the ground, means are present for generating steam, which will not be examined in detail in the present context. The steam heats the area around the injection pipe 101 and reduces the viscosity of the bitumen or very heavy oil present in the oil sand. In the extraction pipe 102, which runs parallel to the injection pipe 101, the oil is recovered and fed back by way of the perpendicular region through the covering rock. Oil is then separated from the raw bitumen in a method-related installation 4 and further processing, e.g. flotation or the like, takes place.

Figure 2:
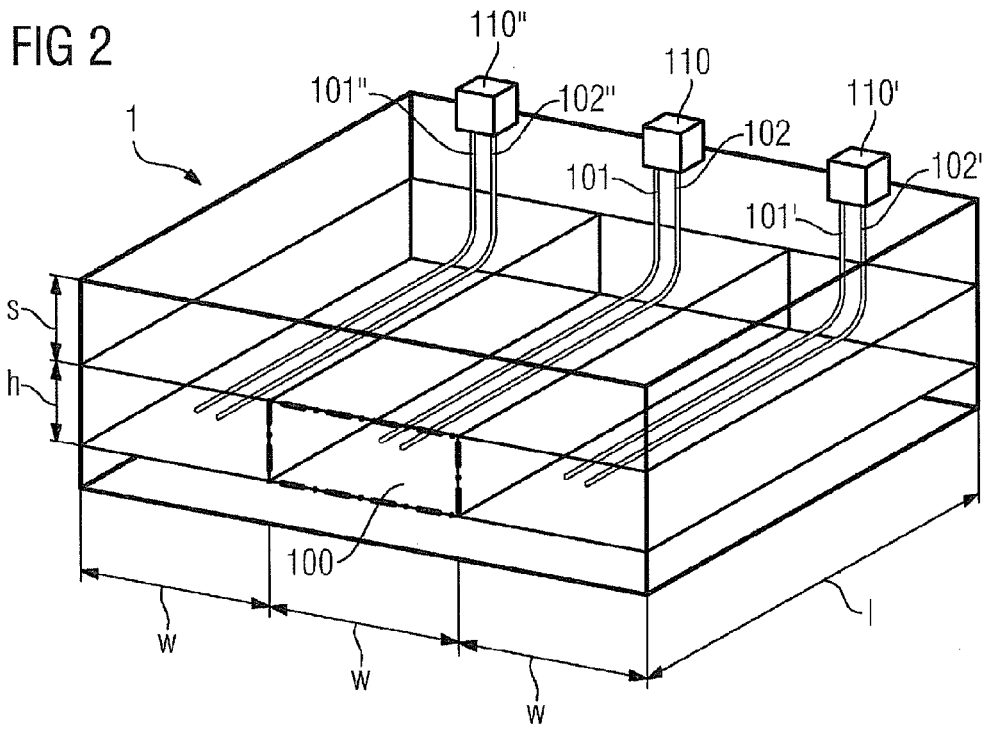
FIG. 2 shows a three-dimensional diagram of elementary units of the reservoir as an oil sand deposit and FIG. 3 to FIG. 6 respectively show cross-sections through the deposit according to FIG. 1 with different arrangements of additional elements for introducing heat.

FIG. 2 shows an oil sand deposit, having a longitudinal extension 1 and a height h. A width w is defined, which is used to define an elementary unit 100 as a reservoir for oil sand. In the prior art the injection pipe 101 and the extraction pipe 102 are routed in a parallel manner on top of one another in a horizontal direction in the unit. The section from the oil reservoir is repeated a number of times on both sides.

FIGS. 3 to 6 respectively show cross-sections through the deposit according to FIG. 1 (line IV-IV) or FIG. 2 (view from front). The dimensions w×h and the arrangement of the extraction pipe 102 on the base of the reservoir 1 are the same. Otherwise alternatives are respectively shown for the injection pipe and/or electrodes.

Figure 3:
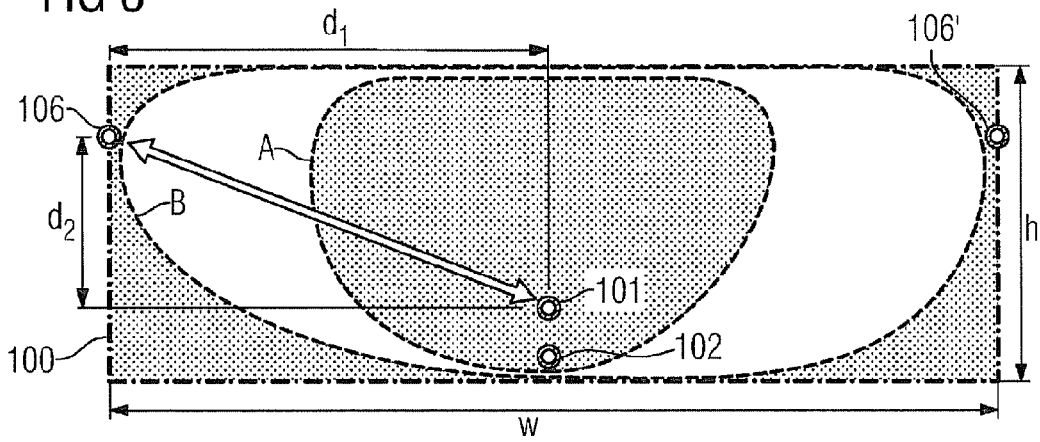

FIG. 3 shows a horizontal pipe pair (well pair), in which the upper of the two pipes, i.e. the injection pipe 101, can optionally also be configured as an electrode. A further horizontal pipe 106 is also present here, being configured specifically as an electrode.

Electrodes 106', 106", . . . are also present in the adjacent sections, so that a regularly repeating structure results.

With the arrangement shown inductive energization takes place by means of the electrical connection at the ends of the additional electrode 106 and the injection pipe 101, resulting in a closed loop.

The horizontal distance between the electrode 106 and the extraction pipe is w/h; the vertical distance between the electrodes 106, 106', . . . and the well pair, in particular the injection pipe, is 0.1 m to around 0.9 h. In practice distances between 0.1 m and 50 m result.

It can be seen from FIG. 3 that a predetermined region is heated by the well pair with the pipes 101, 102, the thermal distribution at a defined time being outlined roughly by the line A. The additional inductive heating between the pipes 101 and 106 advantageously results in the peripheral region in corresponding thermal distributions in the region outlined by the line B, which is asymmetrical in FIG. 3.

Figure 4:
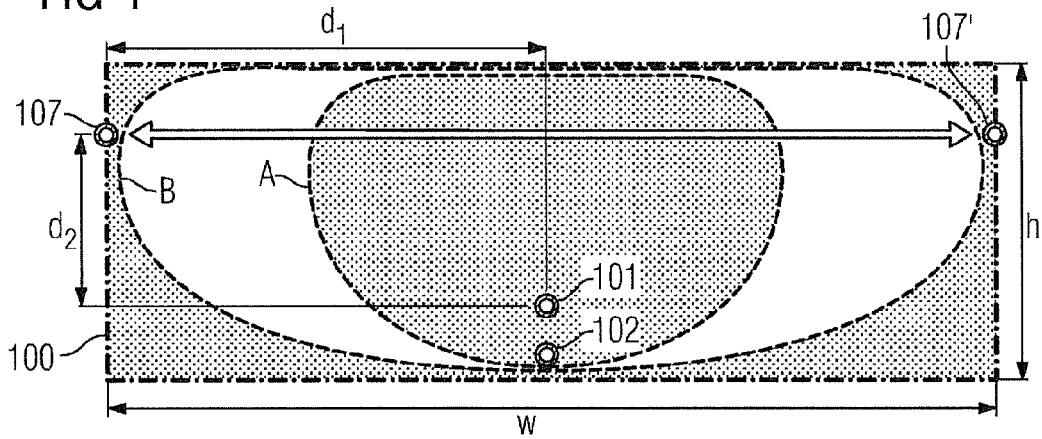

FIG. 4 is based on an arrangement as in FIG. 3, with electrodes 107, 107' being respectively disposed above the well pair on a gap between two well pairs.

FIG. 2 shows the section of the reservoir, which is repeated a number of times on both sides. The horizontal pair with the injection pipe 101 and production pipe 102 can be seen from the cross-section. The further horizontal pipe 107 is configured as an electrical conductor. Two conductors 107, 107' respectively represent the electrodes for inductive energization by means of electrical connection at the ends. The connections here can be made outside the deposit, i.e. above the ground.

With the arrangement according to FIG. 4 the horizontal distance from the electrode 107 to the extraction pipe 102 dl=w/2. The vertical distance corresponds in turn to the one in FIG. 2 with typical values of around 0.1 m to 50 m.

In FIG. 4 the thermal distribution is similar to the one in FIG. 3 but this time it is configured symmetrically.

Figure 5:
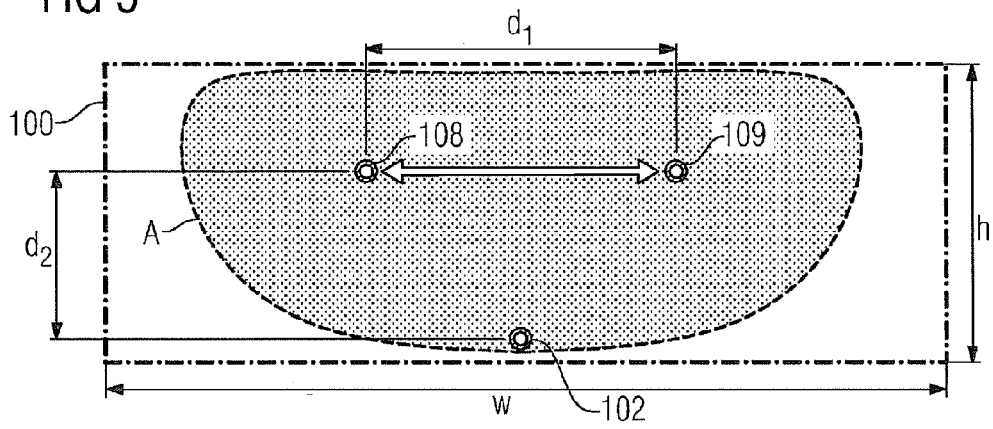

In FIG. 5 the arrangement according to FIG. 2 is disposed so that there are two injection pipes 108 and 109 present per production pipe 101, which equally serve as electrodes. It is thus possible to effect an inductive energization between two adjacent electrodes, in so far as a conductor loop is formed. In FIG. 5 the horizontal distance between the injection pipes 108 and/or 109 and the extraction pipe 102 is around 0.1 w to 0.8 w, signifying values of typically 10 m to 80 m. The vertical distance between the injection pipes 108 and 109 and the extraction pipe 102 is 0.2 h to 0.9 h, corresponding to a value of 5 m to 60 m.

The thermal distribution resulting in FIG. 5 corresponds to the outline A.

Figure 6:
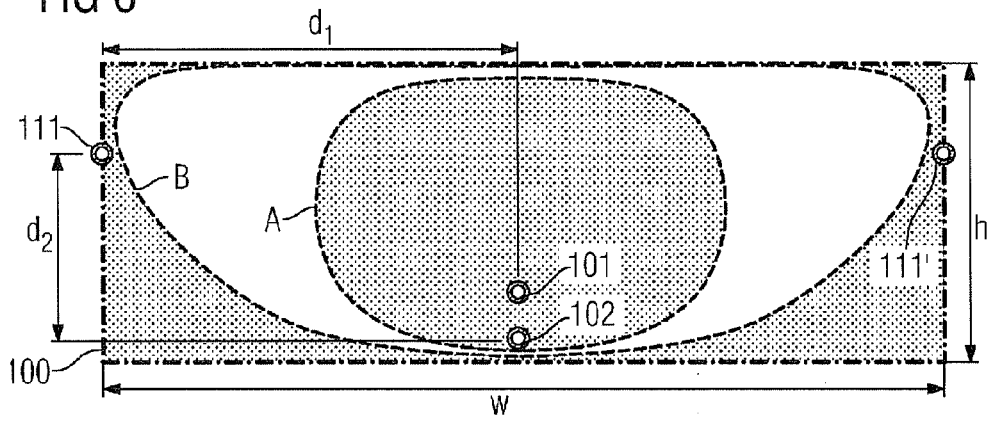

Finally FIG. 6 shows an arrangement like the one in FIG. 2, in which two injection pipes 111, 111' are also positioned above the well pair consisting of the injection pipe 101 and extraction pipe 102 on a gap between two well pairs, with no energization taking place here. The injection pipe is operated so that steam is fed back to the surface. This corresponds essentially to the cycling mode known from the prior art in its preheating phase.

The section from the oil reservoir 1 is again shown in detail, being repeated a number of times on both sides. The well pair consists of the injection pipe 101 and the extraction pipe 102 and the additional horizontal pipe 111 or 111' is operated in steam cycling mode. The repeating injection pipe 111' here acts for the adjacent section of the regularly repeating sections.

With the arrangement shown in FIG. 6 the horizontal section of the further injection pipes to the extraction pipe is again w/h; the vertical distance between the additional injection pipes 111, 111' and the first injection pipe is roughly between 0.1 m to 0.9 h, which corresponds to values between 0.1 and 50 m.

In FIG. 6 a thermal distribution with the outlines according to FIG. 4 results with a symmetrical configuration due to the injection pipes positioned on a gap and repeated to the well pair.

In the examples described above with reference to FIGS. 3 to 6 the inventive measures bring about improved thermal distributions over the cross-section, the outlay remaining reasonable. Efficiency improvements generally result, manifesting themselves in a higher oil extraction yield.

The invention claimed is:

1. A method for the in situ extraction of bitumen or very heavy oil from oil sand seams close to the Earth's surface where thermal energy is supplied to a seam to reduce a viscosity of the bitumen or very heavy oil, the method comprising:

providing a first injection pipe to introduce energy;

providing an extraction pipe, located below the first injection pipe, to recover the liquefied bitumen or very heavy oil;

introducing the thermal energy in each instance in a predetermined section of the seam using at least two separate elements, a predetermined geometry of the elements being maintained in relation to the extraction pipe, and wherein the introducing uses a further pipe as a separate element to introduce steam and/or as an electrode for energization, wherein the injection pipe and the further pipe are connected in a manner of an electrical conductor loop, wherein a plurality of outer regions of the seam are also supplied with thermal energy at least by way of the further pipe, and wherein the first injection pipe and the extraction pipe are disposed one on top of the other, wherein an element unit of the seam includes a cross-section of a width multiplied by a height, and wherein an upward distance of the injection pipe from the extraction pipe is between 0.2 multiplied by the height and 0.9 multiplied by the height.

2. The method as claimed in claim 1, wherein the first injection pipe is also used as a conductor for energization purposes.

3. The method as claimed in claim 1, wherein the further pipe is also used as a second injection pipe to introduce steam.

4. The method as claimed in claim 3, wherein a lateral distance between the first and second injection pipes is between 0.1 multiplied by the width and 0.8 multiplied by the width.

5. The method as claimed in claim 1, wherein the first injection pipe serves as an electrode for energization purposes, and wherein at least two horizontally routed electrodes are present.

6. An apparatus used for the in situ extraction of bitumen or very heavy oil from oil sand seams close to the Earth's surface, comprising:

an extraction pipe per defined element unit of the seam; and at least two further elements including at least an injection pipe, wherein the extraction pipe runs in a horizontal direction on a bottom of the seam and the at least two further elements, run in the horizontal direction above the extraction pipe at a predetermined upward distance and a lateral distance from the extraction pipe in order to introduce energy, and wherein the at least two of the further elements form a conductor loop, wherein the element unit of the seam includes a cross-section of a width multiplied by a height, and wherein an upward distance of a first injection pipe from the extraction pipe is between 0.2 multiplied by the height and 0.9 multiplied by the height.

7. The apparatus as claimed in claim 6, wherein the lateral distance between the first injection pipe and a second injection pipe is between 0.1 multiplied by the width and 0.8 multiplied by the width.

8. The apparatus as claimed in claim 7, wherein the extraction pipe forms a pair with the first injection pipe, and wherein the first injection pipe, located above the extraction pipe, is also configured as an electrode and forms a unit with a first horizontal pipe for energization purposes, and wherein the first horizontal pipe is located a distance from the first injection pipe.

9. The apparatus as claimed in claim 6, wherein the second injection pipe is used to apply steam.

10. The apparatus as claimed in claim 9, wherein the extraction pipe forms a pair with the first injection pipe, and wherein the first injection pipe, located above the extraction pipe, is also configured as an electrode and forms a unit with a first horizontal pipe for energization purposes, and wherein the first horizontal pipe is located a distance from the first injection pipe.

11. The apparatus as claimed in claim 6, wherein the second injection pipe serves as an electrode for energization purposes, and wherein at least two horizontally routed electrodes are present.

12. The apparatus as claimed in claim 11, wherein the extraction pipe forms a pair with the first injection pipe, and wherein the first injection pipe, located above the extraction pipe, is also configured as an electrode and forms a unit with a first horizontal pipe for energization purposes, and wherein the first horizontal pipe is located a distance from the first injection pipe.

13. The apparatus as claimed in claim 12, wherein a second horizontal pipe is configured as an electrode and forms an energization arrangement with the first horizontal pipe of an adjacent element unit.

14. The apparatus as claimed in claim 6, wherein two injection pipes are present per extraction pipe and serving as electrodes for inductive energization.

15. The apparatus as claimed in claim 6, wherein the extraction pipe and the first injection pipe form the pair, and wherein the second injection pipe is respectively disposed above the pair on a gap between two pairs, above which a steam is introduced.

16. The apparatus as claimed in claim 15, wherein the steam is fed back to a surface of the seam.

17. The apparatus as claimed in claim 6, wherein the cross section of the seam is repeated a number of times on both sides of the cross section.

* * * * *